US009120595B2

(12) United States Patent
Chou

(10) Patent No.: US 9,120,595 B2
(45) Date of Patent: Sep. 1, 2015

(54) TAMPER-EVIDENT FOOD CONTAINER

(71) Applicant: Hsin-Hung Chou, Taipei (TW)

(72) Inventor: Hsin-Hung Chou, Taipei (TW)

( * ) Notice: Subject to any disclaimer, the term of this patent is extended or adjusted under 35 U.S.C. 154(b) by 91 days.

(21) Appl. No.: 14/011,953

(22) Filed: Aug. 28, 2013

(65) Prior Publication Data

US 2015/0060455 A1 Mar. 5, 2015

(51) Int. Cl.
*B65D 17/00* (2006.01)
*B65D 77/20* (2006.01)
*B65D 43/16* (2006.01)

(52) U.S. Cl.
CPC ..... *B65D 17/24* (2013.01); *B65D 43/162* (2013.01); *B65D 77/2016* (2013.01); *B65D 2101/0023* (2013.01); *B65D 2543/0062* (2013.01); *B65D 2543/00194* (2013.01); *B65D 2543/00296* (2013.01); *B65D 2543/00509* (2013.01); *B65D 2543/00546* (2013.01); *B65D 2543/00685* (2013.01); *B65D 2543/00731* (2013.01); *B65D 2543/00796* (2013.01); *B65D 2543/00842* (2013.01); *B65D 2577/205* (2013.01); *B65D 2577/2091* (2013.01)

(58) Field of Classification Search
CPC ..... B65D 17/24; B65D 43/16; B65D 81/34; E05B 73/00; E05B 73/0023; E05B 73/0017
USPC ..... 206/1.5; 220/270, 266, 810, 4.23, 4.22, 220/260, 833, 791; 70/63
See application file for complete search history.

(56) References Cited

U.S. PATENT DOCUMENTS

| | | | | | |
|---|---|---|---|---|---|
| 5,897,011 | A * | 4/1999 | Brilliant et al. | ..... | 220/4.23 |
| D646,563 | S * | 10/2011 | Bontrager et al. | ..... | D9/425 |
| 2005/0017007 | A1* | 1/2005 | Sellari et al. | ..... | 220/270 |
| 2005/0184070 | A1* | 8/2005 | Boback et al. | ..... | 220/266 |
| 2006/0289549 | A1* | 12/2006 | Vovan | ..... | 220/791 |
| 2007/0012710 | A1* | 1/2007 | Vovan | ..... | 220/793 |
| 2009/0090712 | A1* | 4/2009 | Vovan | ..... | 220/23.86 |
| 2010/0102074 | A1* | 4/2010 | Parikh et al. | ..... | 220/810 |
| 2012/0005994 | A1* | 1/2012 | Tidball et al. | ..... | 53/484 |
| 2012/0048774 | A1* | 3/2012 | Gingras et al. | ..... | 206/565 |
| 2012/0067009 | A1* | 3/2012 | Bontrager et al. | ..... | 53/467 |
| 2013/0160406 | A1* | 6/2013 | Johnston | ..... | 53/467 |

* cited by examiner

*Primary Examiner* — Steven A. Reynolds
(74) *Attorney, Agent, or Firm* — Rosenberg, Klein & Lee

(57) ABSTRACT

A tamper-evident food container includes a container body and a cover respectively having a coupling flange with sealing structure, and the cover has an enlarged surface, a frangible score line, and a pull tab on at least one end of the frangible score line. when the cover fastens to the container body, the plurality of the male engaging members are fixed into the female engaging members and the downward hem is inserted into the recessed portion; when opening the cover, upward pulling the pull tab to tear the frangible score line for detaching the cover from the second enlarged surface. Thus, the present invention ensures the integrity, security, and the ability to maintain high quality the food reserved in the tamper-evident food container.

3 Claims, 9 Drawing Sheets

TAMPER-EVIDENT FOOD CONTAINER

BACKGROUND OF THE INVENTION

1. Field of the Invention

The invention relates to a food container, particularly to a tamper-evident food container speaker body which is identifiable after it is opened and then closed.

2. Description of the Related Art

Plastic containers of box, cup and bowel types made by means of vacuum molding are suitable for keeping food fresh.

For keeping jelly, pudding, cheese or other liquid food, the food container must be well sealed, avoiding leakage during delivery or transportation.

The U.S. Pat. No. 6,883,678 owing by the inventor discloses a food container sealing structure having a horizontal and vertical double sealing structure to ensure the sealing integrity of the food container.

Further, the consumers gradually pay attention to the food containers which is opened and then closed by other people and therefore the U.S. Pat. Nos. 7,073,680 and 7,118,003 disclose a tamper-evident food container. However, when opening the cover, a strip will be left, having inconvenient on use. Therefore, there is room for improvement.

SUMMARY OF THE INVENTION

It is an object of the present invention to provide a tamper-evident food container to ensure the integrity, security, and the ability to maintain high quality the food reserved in the tamper-evident food container.

It is another object of the present invention to provide a tamper-evident food container without a frangible strip after tearing a core line of the cover, being more convenient to operate.

In order to achieve the above objects, the tamper-evident food container comprises: a container body including a first coupling flange extended around a rim thereof, the first coupling flange having a first horizontal section and a first vertical section, a first endless concave formed in the first horizontal section at an upper side and extended around the container body, and a second endless concave portion formed in the first vertical section at an inner side and extended around the container body; a cover including a second coupling flange extended around a rim thereof for fastening to the first coupling flange of the container body, the second coupling flange having a second horizontal section and a second vertical section respectively fitting the first horizontal section and first vertical section, a first endless convex portion formed in the second horizontal section at a bottom side and extended around the cover for engaging the first endless concave portion of the container body, and a second endless convex portion formed in the second vertical section at an outer side and extended around the cover for engaging the second endless concave portion of the container body; whereby, when the cover fastens to the container body, the first endless convex portion and second endless convex portion of the cover are respectively press-fitted into engagement with the first endless concave portion and second endless concave portion of the container body, and therefore the food container is well sealed;

wherein the container body includes a first horizontal surface extended from both outer sides of the first vertical section and a first enlarged surface with larger area extended from a front side of the first vertical section, and the first enlarged surface has a plurality of female engaging members with a first engaging edge; a raised portion is formed at an outer edge of at least three sides of the first horizontal surface and the first enlarged surface, and a recessed portion is formed between an inner periphery of the raised portion and an interconnected surface of the first horizontal surface and first enlarged surface; the cover corresponding to the first horizontal surface has a second horizontal surface extended from both outer sides of the second vertical section and corresponding to the first enlarged surface has a second enlarged surface extended from a front side of the second vertical section, and the second enlarged surface has a plurality of male engaging members with a second engaging edge for engaging the first engaging edge; a hem is formed at an outer periphery of the second horizontal surface for fitting the recessed portion, and a frangible score line is provided at an interface between the cover and the second enlarged surface; and the cover has a pull tab on at least one end of the frangible score line; whereby when the cover fastens to the container body, the plurality of the male engaging members are fixed into the female engaging members and the downward hem is inserted into the recessed portion; when opening the cover, upward pulling the pull tab to tear the frangible score line for detaching the cover from the second enlarged surface.

In the embodiment, the tamper-evident food container further comprises a hinge part formed at an opposite side of the first enlarged surface of the container body and the second enlarged surface of the cover for rearward lifting the cover.

In another embodiment, the tamper-evident food container further comprises a third enlarged surface and a fourth enlarged surface having the same structure with the first enlarged surface and the second enlarged surface is respectively formed at an opposite side of the first enlarged surface of the container body and the second enlarged surface of the cover has the, a frangible score line is provided at an interface between the cover and the third enlarged surface for detaching the cover from the third enlarged surface, and a pull tab is formed at an end of the frangible score line.

Based on the features disclosed, when the cover closes on the container body, the first endless convex portion engages the first concave portion and the second endless convex portion is fixed into the second endless concave portion to form a well-sealing structure to ensure the sealing integrity of the food container.

DETAILED DESCRIPTION OF THE PREFERRED EMBODIMENT

Figure 1:
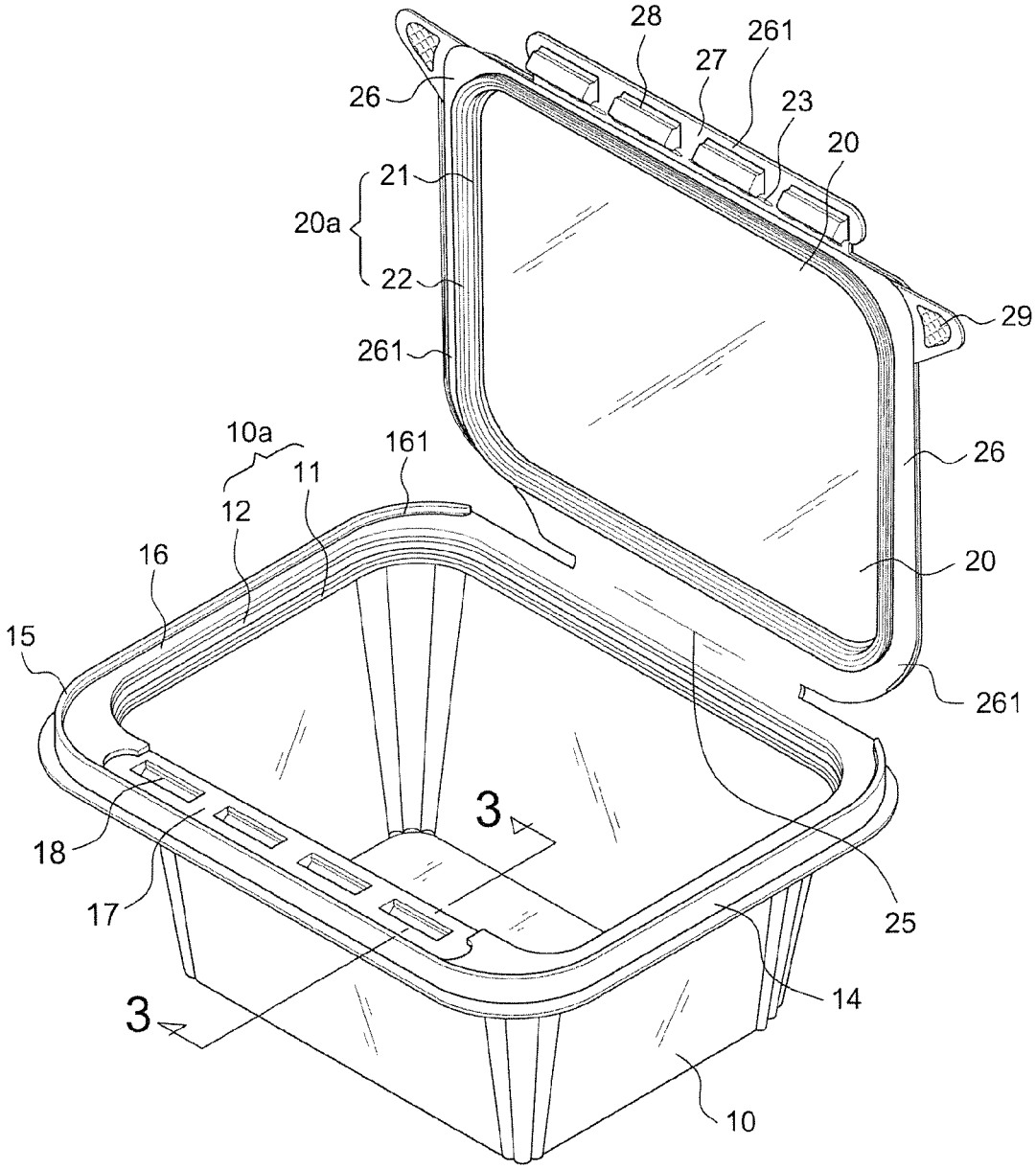
FIG. 1 is a perspective view of the preferred embodiment in accordance with the present invention, illustrating that the cover is opened.
Figure 2:
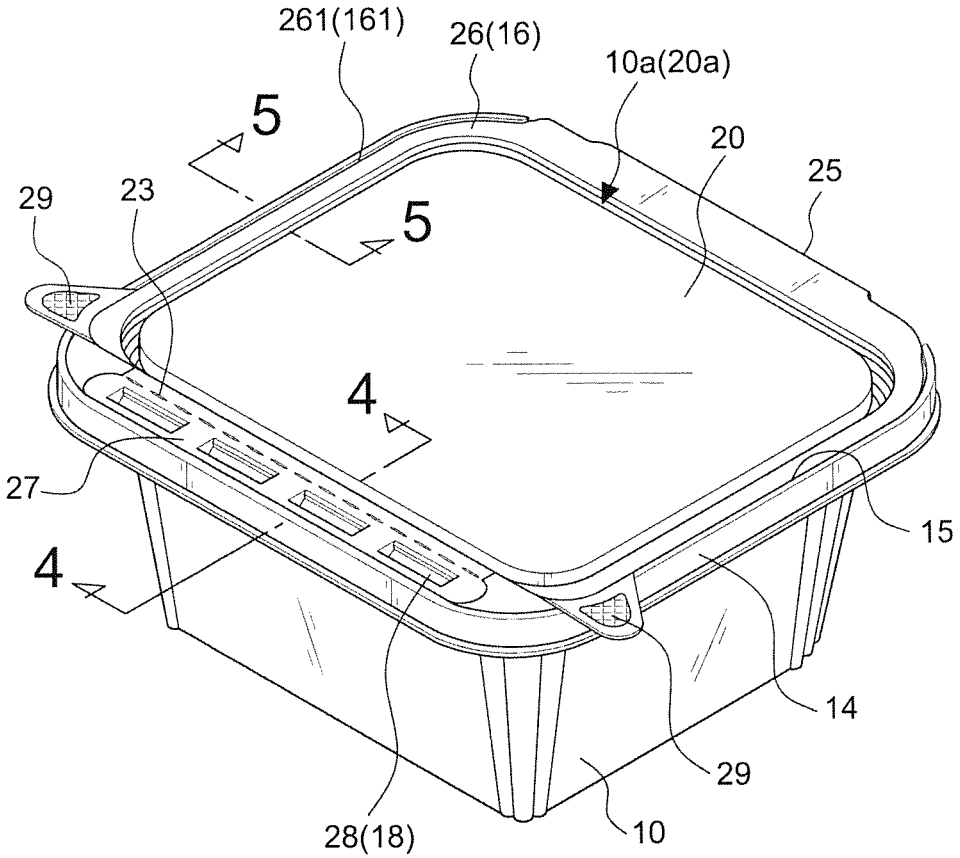
FIG. 2 is a perspective view of the preferred embodiment in accordance with the present invention, illustrating that the cover is closed.
Figure 3:
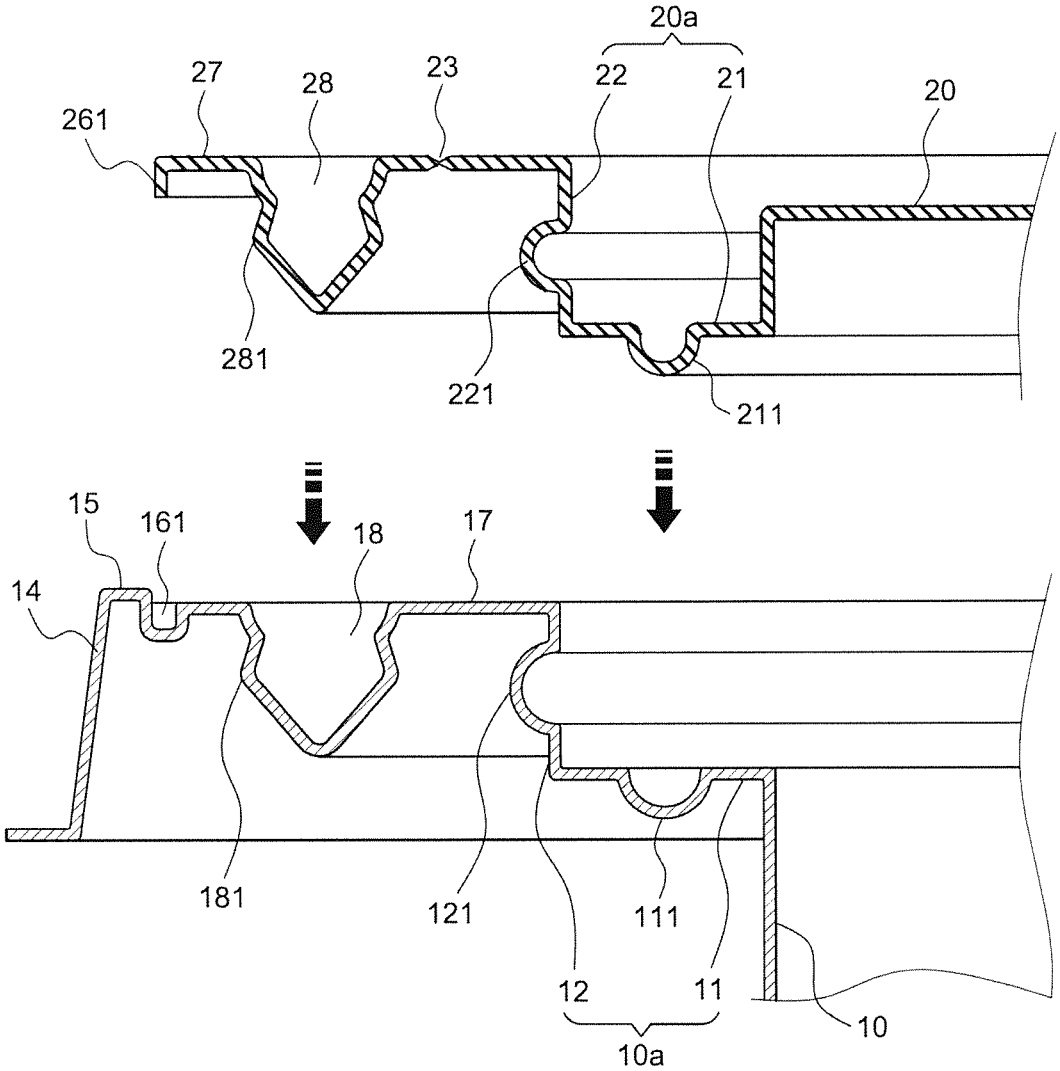
FIG. 3 is a cross-section view taken along the line 3-3 in FIG. 1.
Figure 4:
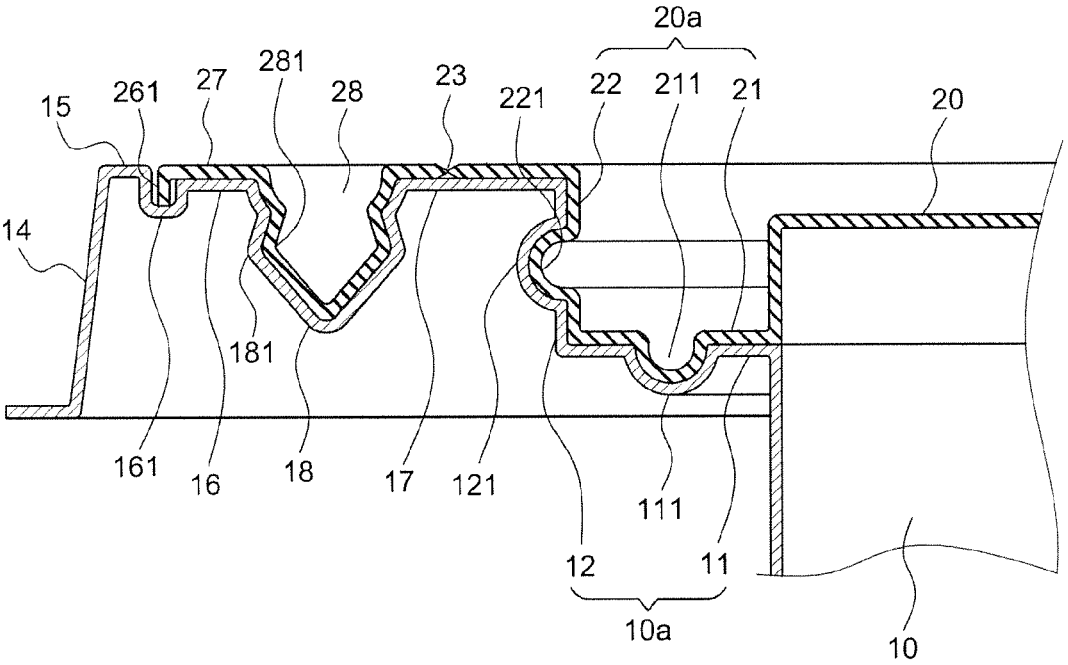
FIG. 4 is a cross-section view taken along the line 4-4 in FIG. 2.
Figure 5:
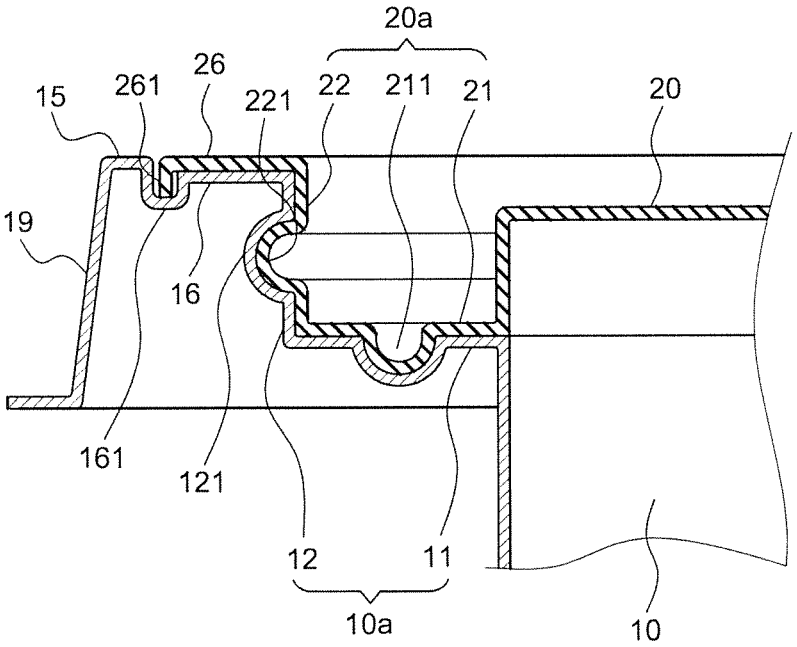
FIG. 5 is a cross-section view taken along the line 5-5 in FIG. 2.

Referring to FIGS. 1 through 5, the preferred embodiment of a tamper-evident food container in accordance with the present invention comprises the following components as discussed in detail below.

A container body 10 includes a first coupling flange 10*a* extended around a rim thereof, and the first coupling flange 10*a* has a first horizontal section 11 and a first vertical section 12. A first endless concave portion 111 is formed in the first horizontal section 11 at an upper side and extended around the container body 10, and a second endless concave portion 121 is formed in the first vertical section 12 at an inner side and extended around the container body 10. A cover 20 includes a second coupling flange 20*a* extended around a rim thereof for fastening to the first coupling flange 10*a* of the container body 10, and the second coupling flange 20*a* has a second horizontal section 21 and a second vertical section 22 respectively fitting the first horizontal section and first vertical section 11, 12. A first endless convex portion 211 is formed in the second horizontal section 21 at a bottom side and extended around the cover 20 for engaging the first endless concave portion 111 of the container body 10, and a second endless convex portion 221 is formed in the second vertical section 22 at an outer side and extended around the cover 20 for engaging the second endless concave portion 121 of the container body 10. When the cover 20 fastens to the container body 10, the first endless convex portion and second endless convex portion 211, 221 of the cover 20 are respectively press-fitted into engagement with the first endless concave portion and second endless concave portion 111, 121 of the container body 10, and therefore the food container is well sealed. The above sealing structure has disclosed in the U.S. Pat. No. 6,883,678 owning by the inventor and thus will not be described in details here.

The present invention is characterized in that the container body 10 includes a first horizontal surface 16 extended from both outer sides of the first vertical section 12 and a first enlarged surface 17 with larger area extended from a front side of the first vertical section 12, and the first enlarged surface 17 has a plurality of female engaging members 18 with a first engaging edge 181; a raised portion 15 is formed at an outer edge of at least three sides of the first horizontal surface 16 and the first enlarged surface 17, and a recessed portion 161 is formed between an inner periphery of the raised portion 15 and an interconnected surface of the first horizontal surface and first enlarged surface 16, 17. Moreover, an external periphery of the raised portion 15 is an external hem 14 of the container body 10 which is prior art and thus will not be described in details here.

The cover 20 corresponding to the first horizontal surface 16 has a second horizontal surface 26 extended from both outer sides of the second vertical section 22 and corresponding to the first enlarged surface 17 has a second enlarged surface 27 extended from a front side of the second vertical section 22, and the second enlarged surface 27 has a plurality of male engaging members 28 with a second engaging edge 281 for engaging the first engaging edge 181; a hem 261 is formed at an outer periphery of the second horizontal surface 26 for fitting the recessed portion 161, and a frangible score line 23 is provided at an interface between the cover 20 and the second enlarged surface 27.

Figure 6:
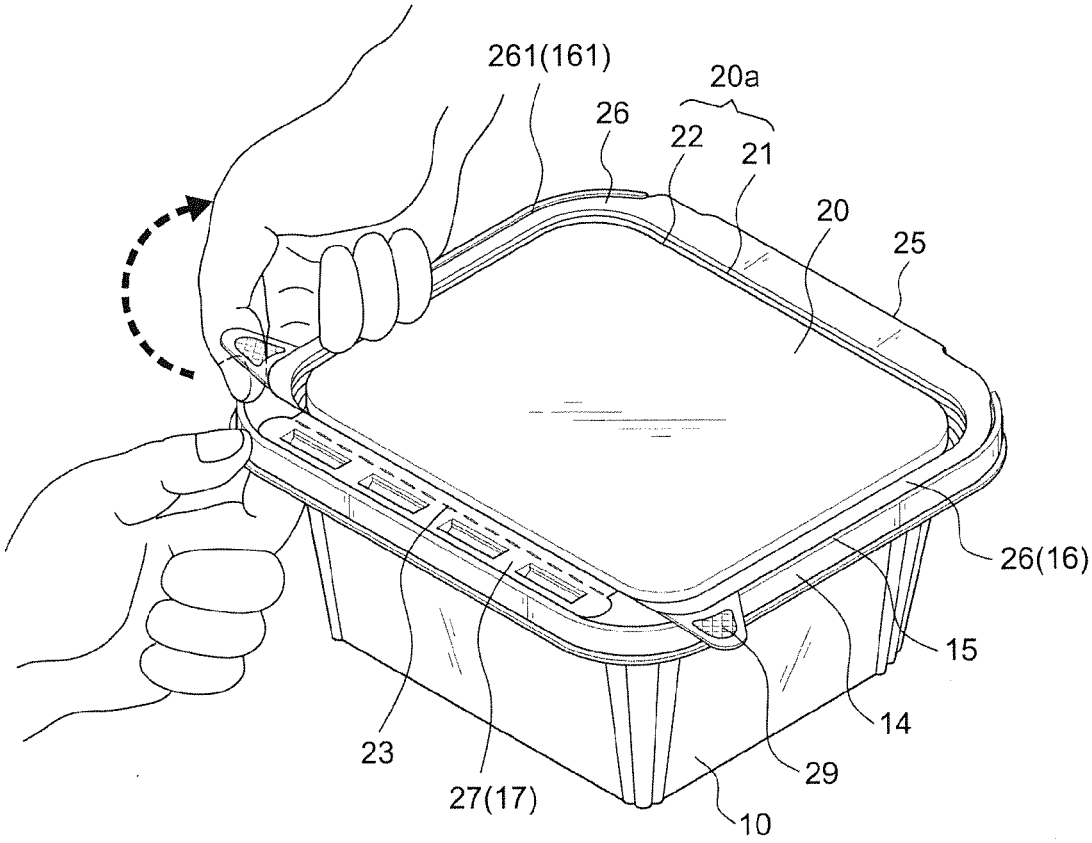
FIG. 6 is an application example of the preferred embodiment in accordance with the present invention.

Further, the cover 20 has a pull tab 29 on at least one end of the frangible score line 23; whereby when the cover 20 fastens to the container body 10, the plurality of the male engaging members 28 are fixed into the female engaging members 18 and the downward hem 261 is inserted into the recessed portion 161. With the referenced to FIG. 6, when opening the cover 20, upward pulling the pull tab 29 to tear the frangible score line 24 for detaching the cover 20 from the second enlarged surface 27.

Figure 7:
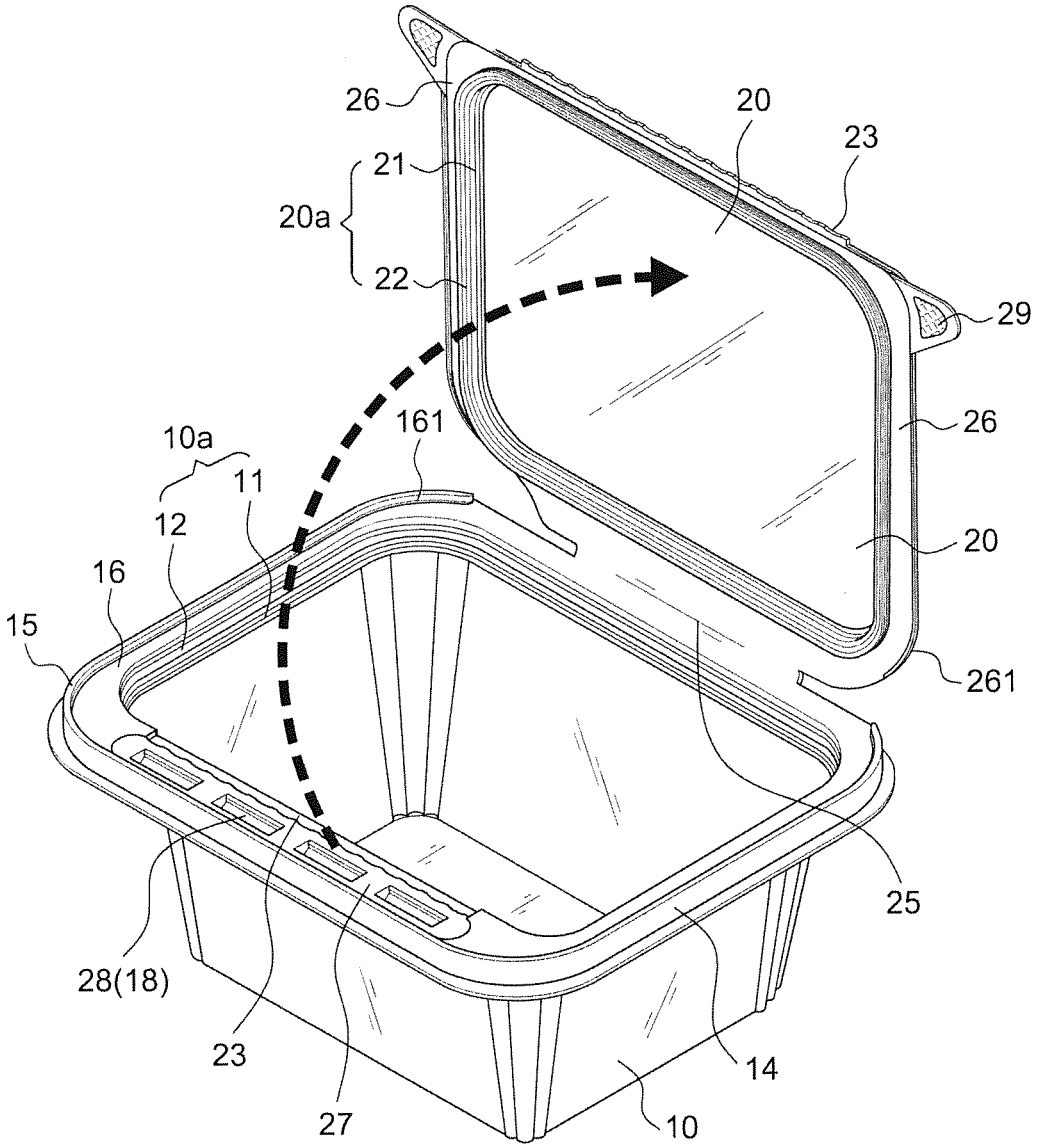
FIG. 7 is a schematic view of the preferred embodiment in accordance with the present invention, illustrating that the cover is tore.

In the embodiment as shown in FIG. 7, the present invention further comprises a hinge part 25 formed at an opposite side of the first enlarged surface 17 of the container body 10 and the second enlarged surface 27 of the cover 20 for rearward lifting the cover 20.

Figure 8:
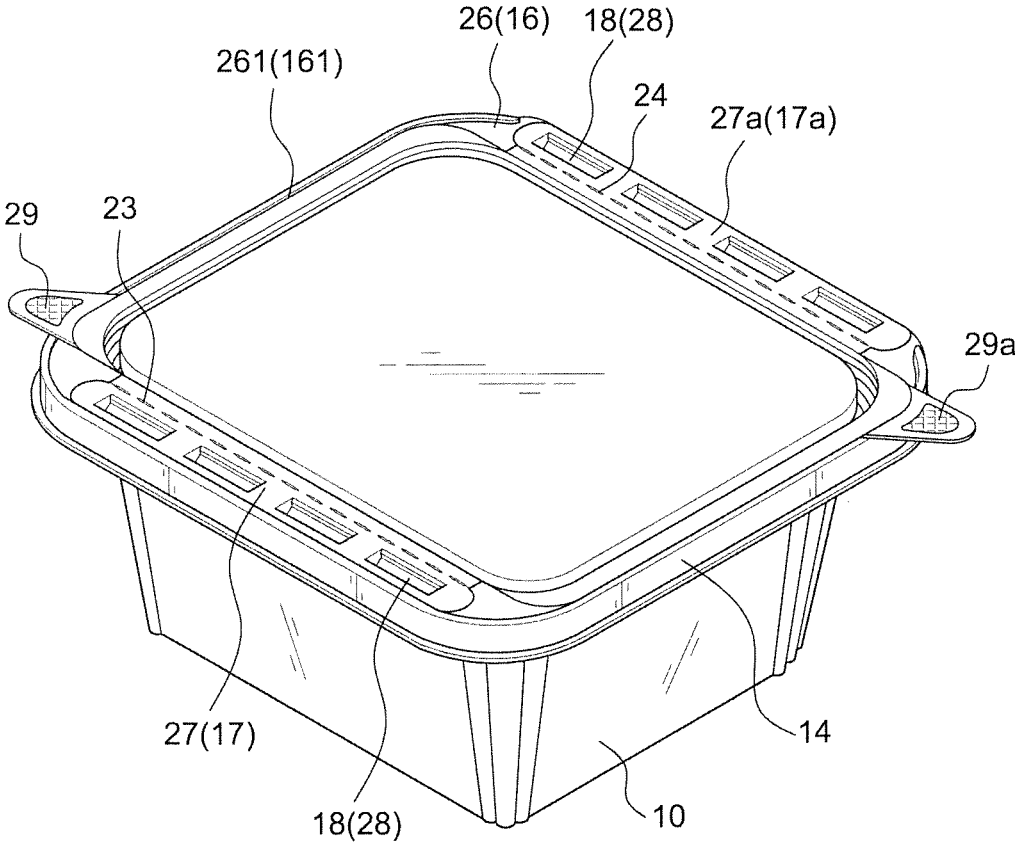
FIG. 8 is schematic view of another embodiment in accordance with the present invention, illustrating that the cover is closed; and, FIG. 9 is a schematic view of another embodiment in accordance with the present invention, illustrating that the cover is tore apart from the container body.
Figure 9:
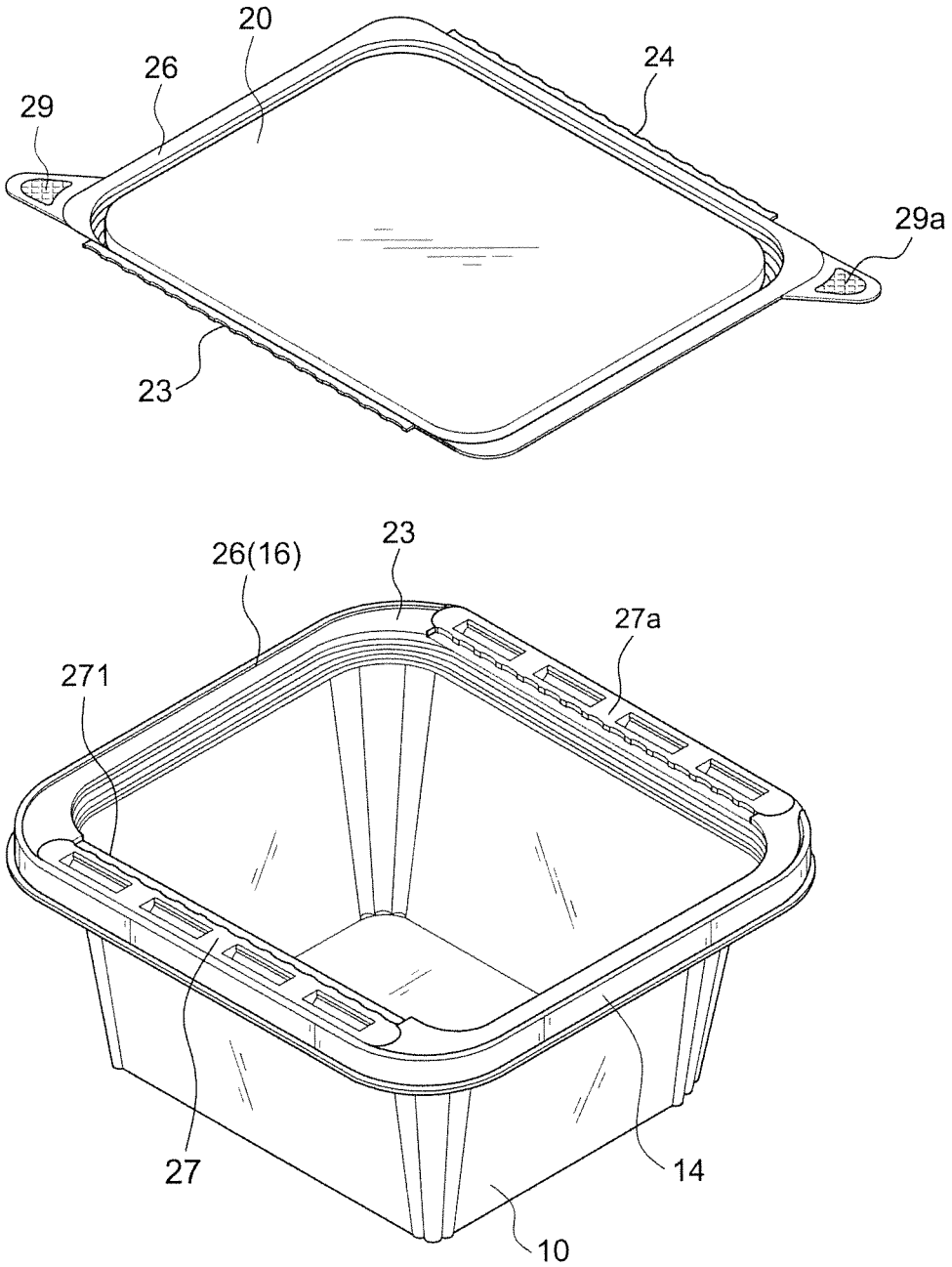

In another embodiment as shown in FIGS. 8 and 9, the present invention further comprises a third enlarged surface 17*a* and a fourth enlarged surface 27*a* having the same structure with the first enlarged surface 17 and the second enlarged surface 27 is respectively formed at an opposite side of the first enlarged surface 17 of the container body 10 and the second enlarged surface 27 of the cover 20, a frangible score line 24 is provided at an interface between the cover 20 and the third enlarged surface 17*a* for detaching the cover 20 from the third enlarged surface 17*a*, and a pull tab 29*a* is formed at an end of the frangible score line 24.

Based on the features disclosed, when the cover 20 closes on the container body 10, the first endless convex portion 211 engages the first concave portion 111 and the second endless convex portion is fixed into the second endless concave portion 121 to form a well-sealing structure to ensure the sealing integrity of the food container.

Due to the fact that the hem 261 at the outer periphery of the second horizontal surface 26 is fitted the recessed portion 161, the cover 20 cannot be opened if the cover 20 is not detached from the second enlarged surface and third enlarged surface 27, 27*a* by tearing the score line 23, 24 and therefore it is easy to distinguish if the food container is opened and then closed. Thus, the present invention ensures the integrity, security, and the ability to maintain high quality the food reserved in the tamper-evident food container.

Moreover, when tearing the core line 23, 24 of the cover 20, no strip will be left, being more convenient than the prior art with a frangible strip.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tamper-evident food container, comprising:

a container body including a first coupling flange extended around a rim thereof, the first coupling flange having a first horizontal section and a first vertical section, a first endless concave formed in the first horizontal section at an upper side and extended around the container body, and a second endless concave portion formed in the first vertical section at an inner side and extended around the container body;

a cover including a second coupling flange extended around a rim thereof for fastening to the first coupling flange of the container body, the second coupling flange having a second horizontal section and a second vertical section respectively fitting the first horizontal section and first vertical section, a first endless convex portion formed in the second horizontal section at a bottom side and extended around the cover for engaging the first endless concave portion of the container body, and a second endless convex portion formed in the second vertical section at an outer side and extended around the cover for engaging the second endless concave portion of the container body; whereby, when the cover fastens to the container body, the first endless convex portion and second endless convex portion of the cover are respectively press-fitted into engagement with the first endless concave portion and second endless concave portion of the container body, and therefore the food container is well sealed;

wherein the container body includes a first horizontal surface extended from both outer sides of the first vertical section, the container body further includes a first enlarged surface extended from a front side of the first vertical section, said first enlarged surface has an area larger than said first horizontal surface, and the first enlarged surface has a plurality of female engaging members with a first engaging edge; a raised portion is formed at an outer edge of at least three sides of the first horizontal surface and the first enlarged surface, and a recessed portion is formed between an inner periphery of the raised portion and an interconnected surface of the first horizontal surface and first enlarged surface;

the cover corresponding to the first horizontal surface has a second horizontal surface extended from said outer side of the second vertical section extending around said cover and corresponding to the first enlarged surface has a second enlarged surface extended from a front side of the second vertical section, and the second enlarged surface has a plurality of male engaging members with a second engaging edge for engaging the first engaging edge; a hem is formed at an outer periphery of the second horizontal surface for fitting within the recessed portion, and a frangible score line is provided at an interface between the cover and the second enlarged surface; and the cover has a pull tab on at least one end of the frangible score line;

whereby when the cover fastens to the container body, the plurality of the male engaging members are fixed into the female engaging members and the downward hem is inserted into the recessed portion; when opening the cover, the pull tab is pulled upward to tear the frangible score line for detaching the cover from the second enlarged surface.

2. The tamper-evident food container as claimed in claim 1, further comprises a hinge part formed at an opposite side of the first enlarged surface of the container body and the second enlarged surface of the cover for rearward lifting the cover.

3. The tamper-evident food container as claimed in claim 1, further comprises a third enlarged surface and a fourth enlarged surface having the same structure with the first enlarged surface and the second enlarged surface is respectively formed at an opposite side of the first enlarged surface of the container body and the second enlarged surface of the cover, a frangible score line is provided at an interface between the cover and the third enlarged surface for detaching the cover from the third enlarged surface, and a pull tab is formed at an end of the frangible score line.

* * * * *